United States Patent [19]

Olson

[11] Patent Number: 4,590,821

[45] Date of Patent: May 27, 1986

[54] BOTTLE CAP REMOVER

[76] Inventor: James C. Olson, 7555 NE 33rd Dr., Portland, Oreg. 97211

[21] Appl. No.: 670,327

[22] Filed: Nov. 9, 1984

[51] Int. Cl.[4] ..... B67B 7/02

[52] U.S. Cl. ..... 81/3.37; 81/3.29; 81/3.25

[58] Field of Search ..... 81/3.29, 3.25, 3.31, 81/3.27, 3.36, 3.37, 3.4, 3.42, 3.07, 3.56

[56] References Cited

U.S. PATENT DOCUMENTS

| | | | |
|---|---|---|---|
| 1,866,125 | 7/1932 | Patterson | 81/3.29 |
| 2,091,150 | 8/1937 | Lee | 81/3.37 |
| 2,559,845 | 7/1951 | Blum | 81/3.56 |
| 2,761,338 | 9/1956 | Hardy | 81/3.29 |
| 3,800,345 | 4/1976 | Feliz | 81/3.37 |
| 4,406,182 | 9/1983 | Antone | 81/3.29 |
| 4,422,355 | 12/1983 | Burns, Jr. | 81/3.29 |
| 4,442,735 | 4/1984 | Chance et al. | 81/3.36 |
| 4,527,450 | 7/1985 | Drosky | 81/3.37 |

FOREIGN PATENT DOCUMENTS

| | | | |
|---|---|---|---|
| 1027241 | 2/1953 | France | 81/3.36 |

*Primary Examiner*—Roscoe V. Parker
*Attorney, Agent, or Firm*—Klarquist, Sparkman, Campbell, Leigh & Whinston

[57] ABSTRACT

A stopper removing device mountable on a bottle. A carriage on the frame of the remover has a removing lip disposed beneath the head of the stopper. Upon downward movement of the levers, the carriage is driven upwardly to extract the stopper S. The levers have handles which are disposed approximately horizontally just after application of the stopper removing device to the neck of a bottle, such handles being gripped and forced downwardly to effect upward movement of the carriage and the stopper relative to the bottle. The levers have open slots slidably engaging studs on the carriage. The carriage has three sets of slides alternately engaging the opposite sides of a frame to mount the carriage in place. A shield is carried by the carriage and disposed above the head of the stopper to prevent the stopper, under gaseous pressure from the interior of the bottle, from being popped upwardly clear of the removing device and into the face of the user.

7 Claims, 5 Drawing Figures

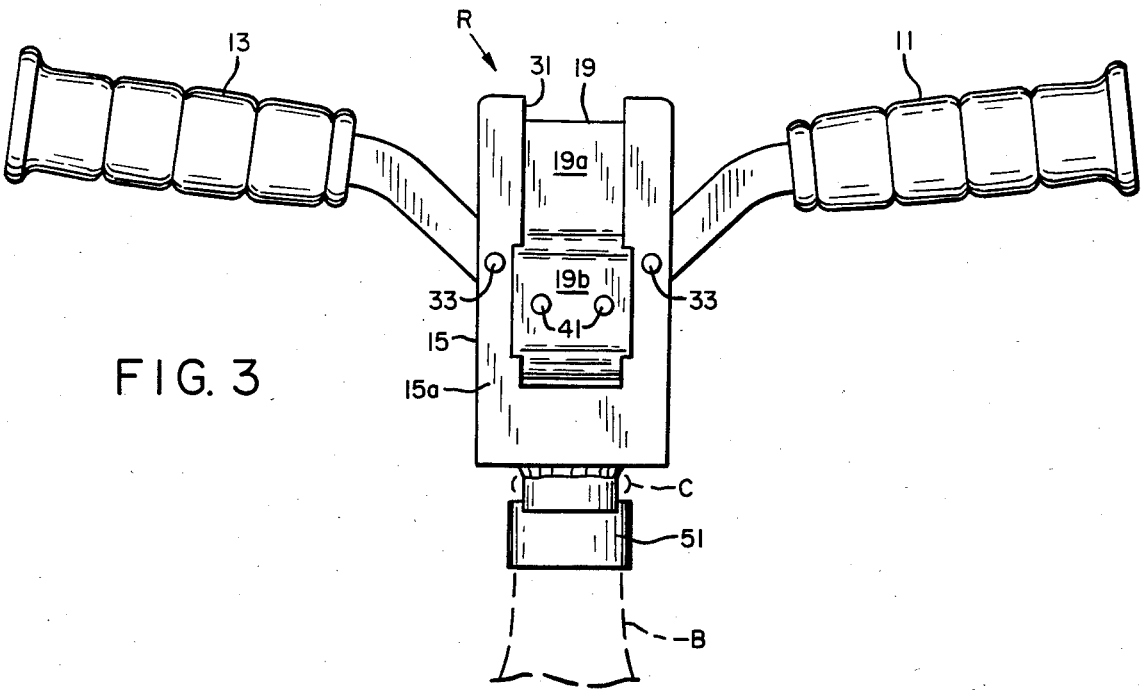
FIG. 3
FIG. 4
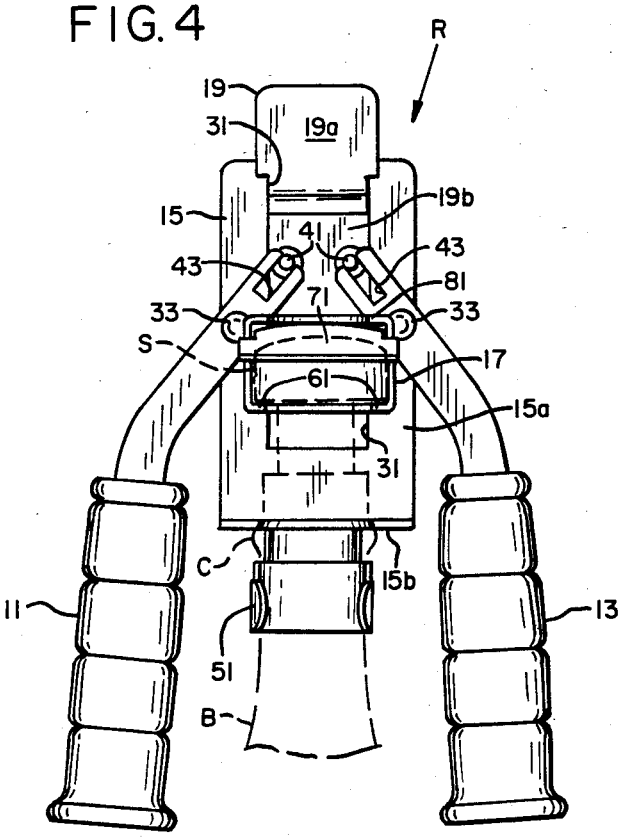
FIG. 5
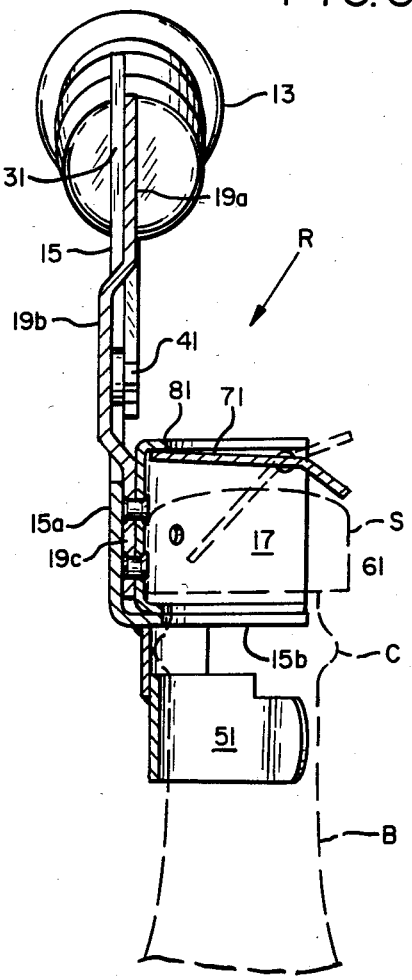

BOTTLE CAP REMOVER

The present invention relates to a bottle closure remover and particularly to one for removing stopper like closures or caps from wine bottles.

Devices for removing stopper like elements from wine and champagne bottles are not per se new. The patent to Antone U.S. Pat. No. 4,406,182 shows a device in which a drive screw is manually turned to pull the stopper from the bottle.

The patent to Burns U.S. Pat. No. 4,422,355 shows a bottle opener in which a stopper engaging element clamps onto the stopper and upon turning movement of the drive screw 50 torques out the stopper.

The older patent to Hector-Anthyme Hardy, U.S. Pat. No. 2,761,338 shows a rather complicated cork remover in which the wheel 19 is turned to bring the arms 20 beneath the cork, whereafter turning of the handle 50 elevates the stem to lift out the cork.

The patent to Blum U.S. Pat. No. 2,559,845 does not relate to stopper or cork removers but instead to a rather complicated arrangement for flaring out the cap on a bottle by a multiple linkage arrangement, the structure including a pair of plier like handles which effect inward movement of the so-called pawls 43 while at the same time applying downward pressure on the plunger 15 and thereby against the pusher plate 25.

The above arrangements are complicated and expensive and the drive screw type require multiple turning movements of the various handles.

A main object of the present invention is to provide an arrangement simpler and less complicated than those in the prior art, in which a stopper can be removed by a simple downward movement of a pair of cork removing levers.

Another object is to provide a stopper remover in which part of the frame of the stopper remover engages a bead or chime on the bottle to establish a positional relationship between the frame of the remover and the bottle so that thereafter by downward movement of a pair of levers, an upward stopper-removing-thrust force can be applied to the stopper to remove it in an effective and simple manner.

A further object of the present invention is to provide a stopper remover in which a shield is provided to prevent a stopper, having once dislodged, from being projected under gas pressure upwardly into the face of the operator.

Various other objects will be apparent from the following description, taken in connection with the accompanying drawings wherein:

FIG. 3 is a rear elevational view of the stopper remover;

FIG. 4 is a view like FIG. 2 but showing the handles as having been forced downwardly to remove the stopper;

FIG. 5 is a cross sectional view in elevation of the stopper remover taken along line 5—5 of FIG. 2;

DESCRIPTION

Figure 1:
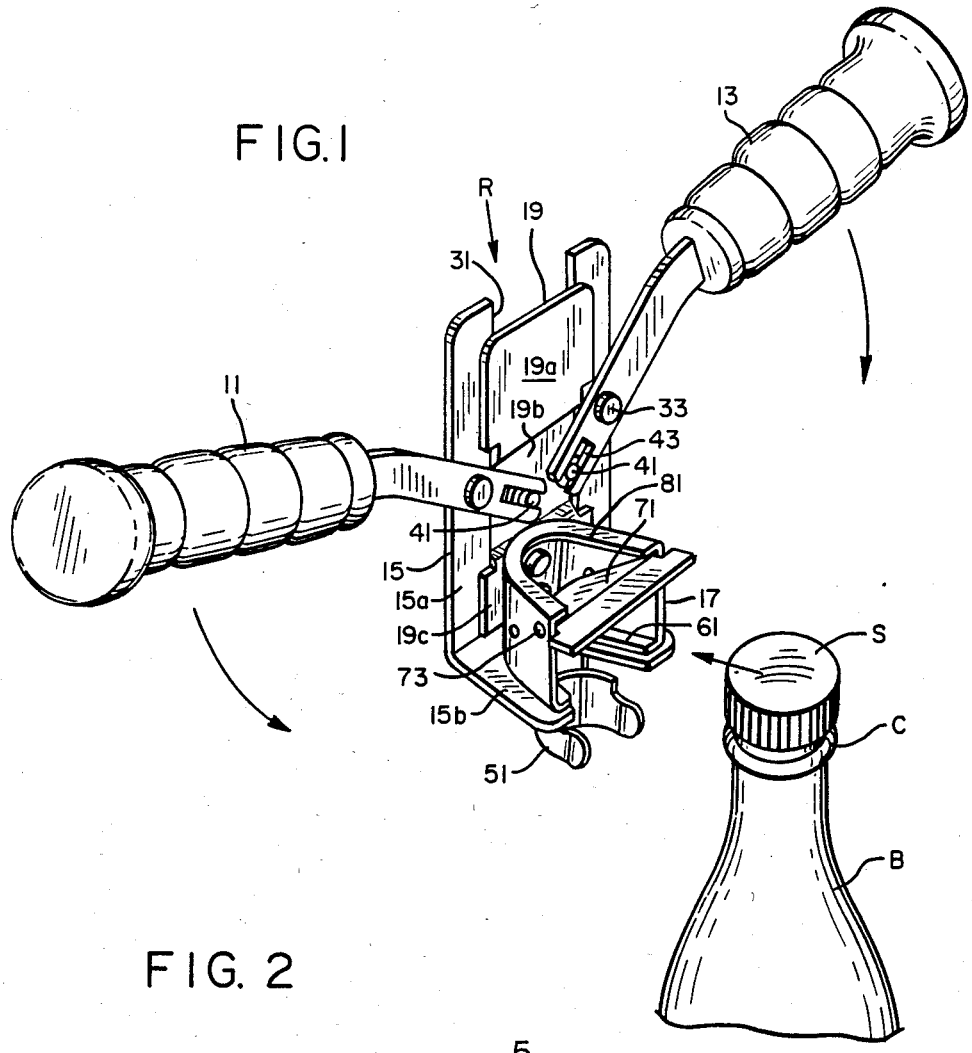
FIG. 1 is a perspective view of a stopper remover showing the same in its beginning position about to be applied to a bottle.

Referring to the drawings, FIG. 1 shows a remover R of my invention, in position to be applied to the cap or stopper S of a wine or champagne bottle B, the bottle typically having a chime or bead C at its upper portion.

In a summary context, a pair of levers 11 and 13 are pivotally mounted on a frame 15 and so connected to a stopper-engaging member or lifter 17 on a carriage 19 that when the levers 11 and 13 are moved downwardly, an upward dislodging force is applied to the stopper S to remove it.

More in detail, the frame 15 is generally L-shaped (FIG. 1) including a vertical portion 15*a* and a horizontal portion or shelf 15*b*. The vertical portion is formed with a deep vertical notch 31 (FIGS. 1 and 3) to provide a pair of upstanding legs on which the handles are pivoted in spaced relation to their inner ends by means of pivots 33.

The carriage 19 is mounted for vertical rectilinear sliding movement on the frame 15 and specifically on the upstanding legs of the vertical frame portion 15*a*. The carriage is shown as being formed of a piece of metal plate having an upper portion 19*a*, a midportion 19*b* and a bottom portion 19*c*. Each of these portions extends laterally beyond the deep notch 31 so as to provide a pair of slides disposed in sliding engagement with the legs of the frame, with the upper and lower portions 19*a* and 19*c* being in sliding engagement with the forward faces of such legs, while the midportion 19*b* is in sliding engagement with the rear faces of such legs.

The midportion is provided with a pair of studs 41, one for each of the levers, each stud being slidably received in an open slot 43 provided in the end of each of the handles.

Figure 2:
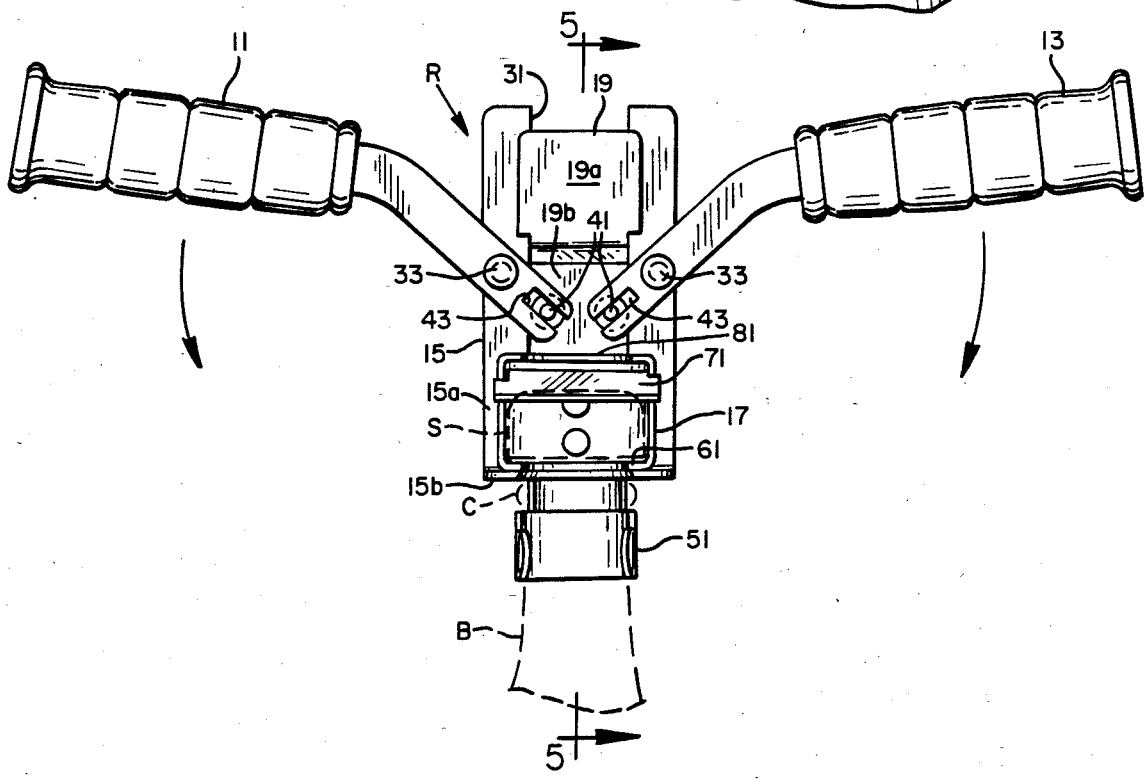
FIG. 2 shows a front elevational view of the stopper remover after having been applied but prior to actuation of the levers.

It is evident from FIGS. 1, 2 and 4 that downward movement of the handles 11 and 13 from the position shown in FIGS. 1 and 2 to the position shown in FIG. 4 will move the carriage from its down position in FIGS. 1 and 2 to its up position in FIG. 4.

Note that the handles preferably are of angular form so that the outer handle portions are more or less horizontal so that the handles can be readily gripped for the application of a downward force thereon. Note that the arms cannot be moved further upwardly than as shown in the FIG. 2 position, because in such position, the lifter 17 is in engagement with the shelf 15*b* to limit such upward movement.

The lower end of the remover is provided with a clasp comprising a pair of resilient wings 51 (FIGS. 4 and 5) which are curved so that they can snap onto the neck of a bottle beneath the chime or bead C to establish a thrust relationship between the frame and the chime, and mount the remover on the bottle.

The shelf 15*b* of the frame is C-shaped, as is evident from FIGS. 1 and 5, to enable the lower frame portion to straddle the neck just above the chime or bead C.

On its lower portion, the carriage carries a stopper lifter 17 of C-shape which is provided at its lower portion with a lip 61 for engagement just beneath the stopper S.

The lifter 17 also is provided with a shield 71 pivoted at 73 on the lifter. Its function will be presently set forth, but note that there is an upper lip 81 which the shield will contact if pivoted upwardly from the position shown in FIG. 1.

OPERATION

With the parts in the position shown in FIG. 1, the remover is moved onto the neck of the bottle to the position shown in FIG. 5, where the shelf 15*b* of the frame is disposed above the chime or bead C, while the clasp 51 is disposed below the chime or bead, thus mounting the remover onto the bottle. This also brings the lip 61 beneath the head of the stopper S.

Now, the arms are moved from the FIG. 2 position to the FIG. 4 position, such movement driving the carriage 19 upwardly to remove the stopper from the bottle. As is evident from FIG. 4, the shield 71 is disposed above the head of the stopper and in position to stop upward movement of the stopper, should the contents of the bottle by gaseous force expel the stopper from the bottle.

Now, the remover is removed from the bottle and the stopper removed from the remover. The stopper can subsequently be manually replaced, if desired.

With the arms lowered as shown in FIG. 4, the removing device can be readily stored since it is now of relatively compact form.

The particular bottle and stopper shown in FIG. 1 is meant to be illustrative. The removing device is obviously applicable for removing the stopper of any kind of bottle wherein the head of the stopper has overhanging portions under which the lip can be disposed. Modern bottles are frequently closed by stoppers made of plastic but whether they are plastic or other material, the removing device is equally capable of removing the stopper.

What is claimed is:

1. In a closure remover for a bottle, a frame, said frame being of L-shape and having a vertical portion and a horizontal portion, the latter being adapted for engagement below a chime on the neck of the bottle to establish a thrust relationship therewith, a carriage for engagement beneath a portion of the closure to establish a thrust relationship therewith said vertical frame portion being vertically slotted, means mounting said carriage in the vertically slotted portion of said frame for vertical rectilinear sliding movement from a down to an up position, a pair of levers having handle portions, means pivotally mounting said levers on said frame for downward movement or for upward movement in a common plane, and for lifting said carriage upon downward movement to apply an upward dislodging force on said closure, and disposing said handle portions approximately horizontally when said carriage is in its down position, and disposing said handle portions in downwardly extending approximately vertical positions when said carriage is in its up position, said L-shaped frame providing clearance for the movement of said handle portions in the just described manner.

2. A closure remover for a bottle as described in claim 1, in which said levers are of downwardly oriented angular form.

3. A closure remover for a bottle as described in claim 2, wherein said carriage has a pair of studs, and said levers having slotted portions slidably engaging said studs.

4. A closure remover for a bottle as recited in claim 1, wherein said carriage has a forward directed C-shaped member having a lower lip for engaging beneath a closure.

5. A closure remover for a bottle as recited in claim 4, wherein there is a shield for said C-shaped member to limit upward propulsive movement of a closure once it is dislodged.

6. A closure remover for a bottle as recited in claim 5, wherein said shield comprises a pivoted flapper member.

7. A closure remover for a bottle, a frame adapted for engagement below a chime on the neck of the bottle to establish a thrust relationship therewith, a carriage for engagement beneath a portion of the closure to establish a thrust relationship therewith, means mounting said carriage on said frame for vertical rectilinear sliding movement from a down to an up position, a pair of levers, means mounting said levers on said frame for downward movement or for upward movement, and for lifting said carriage upon downward movement to apply an upward dislodging force on said closure, and wherein said frame has a vertical notch, said carriage has three pairs of frame contacting slides, a lower pair, a middle pair and an upper pair, the middle pair being disposed on one side of said frame, whereas the lower and upper pairs of slides are disposed on the other side of the frame.

* * * * *